US006277550B1

(12) United States Patent
Elst et al.

(10) Patent No.: US 6,277,550 B1
(45) **Date of Patent: *Aug. 21, 2001**

(54) SILVER HALIDE EMULSION HAVING IMPROVED SENSITOMETRIC CHARACTERISTICS

(75) Inventors: Kathy Elst, Kessel; Johan Loccufier, Zwijnaarde, both of (BE)

(73) Assignee: Agfa-Gevaert, Mortsel (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/435,212

(22) Filed: Nov. 5, 1999

Related U.S. Application Data

(60) Provisional application No. 60/119,064, filed on Feb. 5, 1999.

(30) Foreign Application Priority Data

Nov. 30, 1998 (EP) ..... 98204079

(51) Int. Cl.[7] ..... G03C 1/10
(52) U.S. Cl. ..... 430/567; 430/569
(58) Field of Search ..... 430/567, 569

(56) References Cited

U.S. PATENT DOCUMENTS

| | | | | |
|---|---|---|---|---|
| 5,166,044 | | 11/1992 | Asami | 430/567 |
| 5,420,001 | | 5/1995 | Ito et al. | 430/567 |
| 5,576,173 | * | 11/1996 | Parton et al. | 430/584 |
| 5,763,151 | | 6/1998 | Brust et al. | 430/569 |
| 5,965,343 | * | 10/1999 | Nishimura | 430/567 |

FOREIGN PATENT DOCUMENTS

| | | |
|---|---|---|
| 117 325 A | 1/1976 | (DE) . |
| 0 922 994 A2 | 6/1999 | (EP) . |

* cited by examiner

*Primary Examiner*—Hoa Van Le
(74) *Attorney, Agent, or Firm*—Breiner & Breiner

(57) ABSTRACT

A photosensitive silver halide emulsion has been disclosed, containing tabular silver halide grains present in a numerical amount of at least 50%, said tabular grains having an average aspect ratio of at least 1.2, an average equivalent circular grain diameter of at least 0.1 $\mu$m and an average grain thickness of less than 0.3 $\mu$m, characterized in that said grains further include an organic hole trapping dopant.

In a particular embodiment said photosensitive silver halide emulsion is containing tabular silver halide grains having a core and an outermost shell, wherein said outermost shell of the grains includes an organic hole trapping dopant satisfying formula (I):

formula I

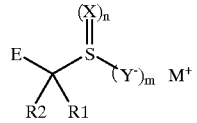

wherein

X and Y each independently represent O, S or Se;

R1 and R2 each independently represents and R represents hydrogen, a substituted or unsubstituted alkyl, a substituted or unsubstituted aryl, a substituted or unsubstituted aralkyl a substituted or unsubstituted heteroaryl;

wherein R1 and R2 can be the same or different and may form a ring;

E represents a group linked to the carbon atom by a heteroatom, having at least one free electron pair;

$M^+$ is a proton or an inorganic or organic counterion;

m and n each represents an integer wherein m equals 1 and n equals 1 or 2.

17 Claims, No Drawings

SILVER HALIDE EMULSION HAVING IMPROVED SENSITOMETRIC CHARACTERISTICS

This appln claims benefit of provisional appln 60/119,064 Feb. 5, 1999.

FIELD OF THE INVENTION

The present invention relates to a photosensitive emulsion for use in photosensitive elements, wherein said emulsion comprises tabular grains having an improved photosensitivity.

BACKGROUND OF THE INVENTION

Photographic industry has always been working with photographic materials wherein it was desired to attain a satisfactory response to light with a well-defined minimum energy content. This light energy should trigger a chemical or physical activity leading to a change in the exposed material which should be immediately visible or, being intrinsically present, should be visualized afterwards by an additional treatment, also called processing step. Since quite a long time there exists a strong and ever lasting demand for photosensitive materials having an improved sensitivity in that said materials should respond to a more and more decreasing amount of light energy. One of the most interesting possibilities is found in photosensitive materials wherein the primary light-activated change exists on an atomic or molecular scale which in a secondary step can be multiplicated by several orders of magnitude in order to visualize the first light interaction in the material. This 'two-step' mechanism of image formation mechanism is e.g. encountered in silver halide materials which form the main subject of the present invention. It is clear that sensitivity in this type of materials is determined by the efficiency the different steps (also determined by minimization of loss processes) between light interaction with silver halide and formation of the visual image can proceed with. This invention will therefore especially be focused on the way in which the first molecular light-induced change in silver halide crystals (also called latent image) is realized. Improvements in this stage should indeed be expected to give rise, after development, to the formation of a visual image having improved sensitometric characteristics.

The efficiency of the latent image formation depends on many factors and can therefore be influenced in a lot of differing ways. The best result is expected to be realized indeed if each photoelectron in the silver halide crystal reaches the deepest electron trap thereby forming a latent image. This means that recombination between holes and electrons that are created after light absorption is prevented as much as possible. Many solutions have since quite a long time been proposed but all of them have hitherto shown a limited result. One can e.g. as a prime measure try to lower the depth of an electron trap in order to increase the capture probability. Chemical sensitization with e.g. sulphur, gold, selenium and other compounds or combinations thereof has therefore often been used for this purpose.

Another way to prevent recombination of holes and electrons after their generation is the temporary interception of these species at local traps with intermediate trap depth. This can be performed by creating an internal distortion in the crystal lattice, e.g. by the local incorporation of an increased amount of iodide in the core or in a small zone or band within the grain. Although this method leads to a sensitivity gain by decreasing the electron-hole recombination, another important feature like developability, which is particularly desired in modern photographic materials for use in rapid processing systems is deteriorated by the presence of iodide.

Increasing the sensitivity of a silver halide emulsion can also be realized by increasing the efficiency of electron transfer from a spectral sensitizer to the silver halide grain which can in principle be carried out with the help of a supersensitizer.

Looking at the activity of the sensitizing dye, gain in sensitivity cannot only be realized by increasing the efficiency of dye sensitization but can also be realized by decreasing dye desensitization, wherein said desensitization is e.g. due to an increasing dye concentration at the grain surface. Combination of an electron donating compound like ascorbic acid with specific cyanine and merocyanine dyes as described in U.S. Pat. No 4,897,343 is an efficient measure in order to reach that goal. Electron-donating compounds attached to a sensitizing dye or a silver halide absorptive group have also been used to get a additional sensitizing effect.

Examples thereof have been described in U.S. Pat. Nos. 5,436,121; 5,478,719 and 4,607,006.

Another interesting way in order to make decrease recombination effects consists in the introduction of hole traps like silver clusters or defined complexes, as e.g. metal complexes, also called dopants, in the silver halide crystal. Silver clusters can be created in the crystals by reduction sensitization, therefore treating the emulsion crystals during precipitation with a reducing agent like e.g. tin compounds, polyamine derivatives, hydrazines, ascorbic acid and analogues, etc., or by creating well defined conditions in the precipitation vessel for pH- and/or pAg without requiring use of any reducing substance. So in U.S. Pat. No. 3,892,574 a method has been described, wherein during precipitation of the silver halide or before or during physical ripening small silver specks (which are so small that they do not give spontaneously developable fog) are created in reducing conditions. The same can be said for silver halide preparation methods as described in U.S. Pat. No. 3,957,490; where at the end of a reduction periode an oxidizing agent is introduced in the silver halide emulsion before chemical sensitization. Most of the methods mentioned before however give rise to fog to a lesser or larger extent so that this poses serious problems.

In all the concepts mentioned hereinbefore experimental evidence has been found that these silver clusters can easily be formed on {111}-AgBr crystal faces if compared e.g. with {100}-AgBr and {100}-AgCl crystal faces.

OBJECTS OF THE INVENTION

It is therefore a first object of the present invention to provide an emulsion for use in a photosensitive element, wherein said emulsion shows improved sensitometric properties, especially sensititivity, after coating.

It is a further object of the present invention to provide, in particular, a photosensitive silver halide emulsion comprising {111} tabular silver halide grains including a new type of doping agents.

It is still another object of the present invention to provide a photosensitive element comprising the silver halide emulsion grains in photosensitive layers, leading to the said gain in speed after processing of said element.

Further objects and advantages of the invention will become apparent from the description with the accompanying examples given hereinafter.

SUMMARY OF THE INVENTION

The above mentioned objects are realized by providing a photosensitive silver halide emulsion, containing tabular silver halide grains in a numerical amount of at least 50%, said tabular grains having an average aspect ratio of at least 1.2, an average equivalent circular grain diameter of at least 0.1 $\mu$m and an average grain thickness of less than 0.3 $\mu$m, characterized in that said grains further include an organic hole trapping dopant.

In a particular embodiment said photosensitive silver halide emulsion is containing tabular silver halide grains having a core and an outermost shell, wherein said outermost shell of the grains includes an organic hole trapping dopant satisfying formula (I):

(I)

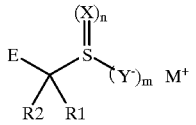

wherein

X and Y each independently represent O, S or Se;

$R^1$ and $R^2$ each independently represents hydrogen, a substituted or unsubstituted alkyl, a substituted or unsubstituted aryl, a substituted or unsubstituted aralkyl a substituted or unsubstituted heteroaryl;

wherein $R^1$ and $R^2$ can be the same or different and may form a ring;

E represents a group linked to the carbon atom by a heteroatom, having at least one free electron pair;

$M^+$ is a proton or an organic or inorganic counterion;

m and n each represents an integer wherein m equals 1 and n equals 1 or 2.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications and equivalents as may be included within the spirit and scope of the invention as defined by the appending claims.

The present invention as described in the foregoing summary will now be explained in detail. It has been found surprisingly that the sensitivity of photosensitive materials comprising a silver halide emulsion having tabular silver halide grains or crystals can be improved as referred to hereinbefore by the introduction of organic molecules acting as organic hole trapping dopants. More in particular said organic molecules are preferably characterized by the following formula (I):

formula I

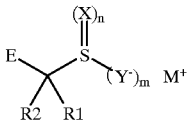

wherein the symbols in the general formula have the following meaning:

X and Y each independently represent O, S or Se;

$R^1$ and $R^2$ each independently represents hydrogen, a substituted or unsubstituted alkyl, a substituted or unsubstituted aryl, a substituted or unsubstituted aralkyl a substituted or unsubstituted heteroaryl; and wherein $R^1$ and $R^2$ can be the same or different and may form a ring;

E represents a group linked to the carbon atom by a heteroatom, having at least one free electron pair;

$M^+$ is a proton or an inorganic or organic counterion;

m and n each represent an integer wherein m equals 1 and n equals 1 or 2.

Organic molecules satisfying formula (I) act as hole trapping agents after occluding them in the silver halide lattice. The said hole trapping agents are defined as compounds which release an electron for reaction with a positive hole formed in the silver halide crystal lattice after absorption of a photon.

For $R^1$ and $R^2$ in formula (I) the substituted alkyl-, aryl or aralkyl groups can also contain other functional substituents like hydroxyl-, amine-, carboxyl-, ether-, carboxylic acid group, etc. This means that the salts of polyacids like oxalic acid, malonic acid, maleinic acid, etc. but also of tri-, tetra- and higher carboxylic acids are included too.

For "$M^+$" in the formula (I) all metals that can form a water soluble salt with e.g. a sulfinic acid group according to the formula (II) can be used. Alkaline earth metals and even more preferred alkaline metals are possible in the context of the present invention. On the other hand "$M^+$" can be an organic group and more preferably is an unsubstituted or substituted ammonium-cation in form of $N^+R^3R^4R^5R^6$ in that case wherein the groups $R^3$ to $R^6$ may be the same or different and wherein each of $R^3$ to $R^6$ independently represents H, unsubstituted or substituted alkyl, unsubstituted or substituted aryl etc. Alternatively also an onium ion differing from the ammonium-cation presented hereinbefore is possible, where the positive charge is situated on another element like e.g. phosphor, selenium, iodium, tellurium, sulphur, etc. instead of on nitrogen, thus representing a phosphonium, selenonium, iodonium, telluronium or sulphonium ion.

Another hole-trapping compound which can be used in combination with the hole-trapping compound according to the general formula (I) for incorporation in the tabular silver halide crystals of the emulsion according to the present invention is formic acid or its (alkaline earth metal or alkaline metal) salt.

It is clear that the size of the molecule represented by formula (I) is important in order to provide effective incorporation in the silver halide matrix. In principle the valency of the metal ion can be one, two or even more. Like the anion which is a part of the compound represented by the formula (I) the organic cation should preferably be as compact as possible, although there has not been observed a definite restriction for its incorporation.

Typical examples of hole trapping agents according to the formula (I) are given below:

compound I

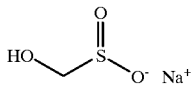

-continued compound II

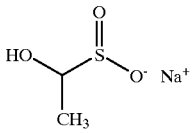

compound III

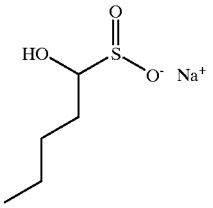

compound IV

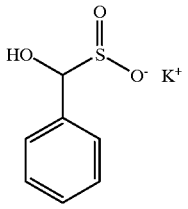

compound V

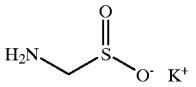

compound VI

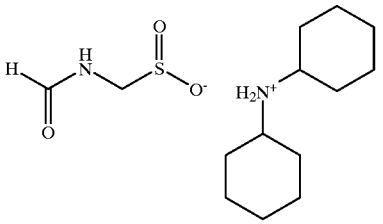

compound VII

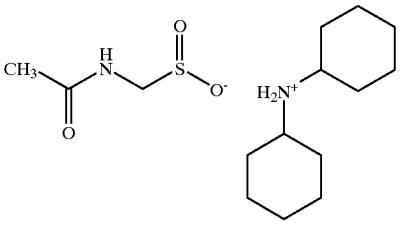

compound VIII

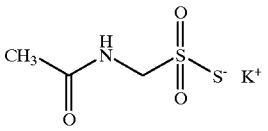

compound IX

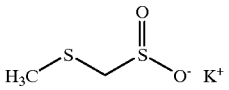

compound X

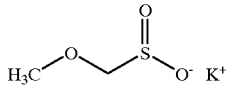

-continued compound XI

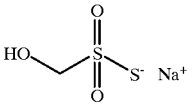

In a preferred embodiment of the general formula (I) X and Y are both oxygen, so that the structure is corresponding with the one as for all compounds mentioned above, except for the compounds VIII and XI, wherein Y is sulphur.

When X and Y each represents oxygen the formula (I) is represented as formula (II) hereinafter (II)

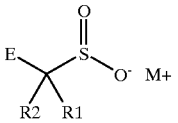

wherein:

$R^1$ and $R^2$, $M^+$ and E have the same meaning as set forth hereinbefore. The least complex molecule according to the formula (II) is thus $CH_3SO_2H$, whereas the least complex α-hydroxymethyl sulfinic acid is $HOCH_2SO_2H$. In a preferred embodiment the emulsion of the present invention thus comprises as an organic hole-trapping dopant according to the formula (I) a rongalite, present as a sulfinic acid or an inorganic or organic salt thereof and even more preferred as a α-hydroxymethyl sulfinic acid or a salt thereof (called a "rongalite").

α-hydroxymethyl sulfinic acids or salts are commercially available (as "rongalites") or can be prepared as described by Mulliez and Naudy (Tetrahedron 1993,49,2469–2476). In this publication, references are found to older publications, describing the preparation of alfa-hydroxylmethyl sulfinic acids. The synthesis of (α-aminomethyl sulfinic acids has been described by Mulliez et al. With R1 and R2 hydrogen they readily available from rongalite (J. Org Chem. 1996, 61, 5648–5649). Further synthesis is described in WO 98/04522 and in Tetrahedron, 50 (18), 5401–5412.

Amounts of organic hole trapping dopant preferably used in the tabular grain emulsion crystals of the present invention are situated between $10^{-2}$ and $10^{-8}$ mole per mole of silver halide but most preferably between $5\times10^{-3}$ and $10^{-8}$ mole per mole of silver halide.

Another essential feature of the present invention is the site where the organic hole trapping dopant is introduced into the crystal volume of the tabular grains or crystals of the emulsions according to the present invention. The site where the said dopant is introduced obviously depends on the time schedule during precipitation of the crystal. In a preferred embodiment the tabular silver halide grains or crystals have the organic hole trapping dopant incorporated into an outermost shell.

The formation of a silver halide emulsion can in a most general way be carried out by introducing a soluble silver salt together with a soluble halide as reactants in an aqueous solution of a binder like the preferred gelatin, well-known as colloidal stabilizer. After a first nucleation step where the nuclei are formed, the growth phase will proceed under the continuous addition of both reactants. During precipitation the whole process is normally carried out in controlled conditions of pH and pAg.

An important element of this invention during said preparation is the presence of an oxidizing agent during the addition of the compounds according to formula (I) at the precipitation stage. This oxidizing agent is preferably added before the organic hole trapping dopant is injected during precipitation of the silver halide emulsion crystals. Addition of said oxidizing agent can be carried out at once or in a certain periode of time, preferably under stirring conditions in order to promote homogeneity of the obtained solution which should be added. The type of oxidizing agent to be used depends on the oxidizing power needed to get optimal hole trapping results but the actual experimental result is also influenced by the amount of the chosen oxidizing agent. The most preferred oxidizing agent which should be added to the solution of compounds having a structure as given in the general formula (I) before their addition to the reaction vessel wherein silver halide is precipitated, is p-toluene thiosulphonic acid or a salt thereof which can be a sodium salt or any desired other metal salt. Introduction of the oxidizing agent is preferably carried out just before addition of the hole trapping agent.

As the silver halide grains or crystals have the organic hole trapping dopant preferably incorporated into an outermost shell it is clear that precipitation has already been performed to a certain extent before said oxidant is added to the solution containing the organic hole trapping agent according to the formula (I) and before the said solution, after stirring, has been added to the precipitation vessel wherein the emulsion preferably having tabular core-shell grains or crystals are precipitated.

Compounds of the present invention which satisfy general formula (I), and even combinations of both of them, can be introduced during precipitation of the silver halide grains in different ways: via the silver salt inlet or via a separated third inlet system. Attention should be paid to the position of the third inlet which is used for the addition of the hole-trapping agent of the present invention. This should be mounted in such a way that the hole-trapping agent is supplied underneath the surface of the solution where the silver halide is precipitated. Further this inlet itself should be positioned closer to the silver salt inlet than to the halide inlet. The injection of the hole-trapping agent as close as possible to the silver salt inlet is preferred while the combined and simultaneous addition of the hole-trapping agent and the silver salt solutions through one inlet is one of the ultimate and most preferred configurations which can be used in the present invention. This can be said about all the system configurations in which solutions of hole-trapping agent and silver salt are mixed together before the formation of the silver halide itself.

Introduction of the organic hole trapping dopant can be carried out throughout the whole precipitation step of the silver halide emulsion, e.g. starting together with the nucleation step and ending together with the end of the growth step, thus leading to a homogeneous distribution of the dopant(s) over the whole crystal volume of the emulsion crystals thus formed, but as has already been said, in a preferred embodiment addition of the organic hole trapping agent(s) according to the formula (I), together with or immediately after addition of an oxidizing agent as set forth, is preferably carried out when at least 5%, i.a. when the nucleation step has been partially or wholly completed, of the total amount of silver needed for the whole precipitation reaction is used. In a preferred embodiment the nucleation step should have been performed completely before introduction of organic hole trapping agent(s) according to the general formula (I), together with or immediately after introduction of an oxidizing agent, i.a. after at least 5% and more preferably after 10% of all silver halide has been precipitated into the reaction vessel. Said introduction can be performed at a constant flow rate or at a increasing, decreasing or fluctuating flow rate or even with a flow which is intermitted once or several times. This means that all types of concentration profiles of the compounds satisfying formula (I) in the silver halide grains are possible. Amounts of organic hole trapping dopants to be incorporated are preferably situated between $10^{-8}$ and $10^{-2}$ mole per mole of silver halide.

The compounds of formula (I) are introduced as an aqueous solution to the silver halide emulsion which is already formed but less soluble compounds can be incorporated by using a water soluble hydrophilic organic solvent. If the solutions of these compounds are not added together with either the silver salt solution or (less preferable) the halide salt solution, a separate introduction under or above the surface of the precipitating emulsion can be carried out by using one or more injection means. The position can be freely chosen and can be optimized. The addition can be carried out under hydrostatic pressure as driving force or by an motor-driven injection system which, if desired, can be automatic and computor controlled. Attention should be however be paid to the position of the third inlet, if used, for the addition of the hole-trapping agent of the present invention. The inlet should further indeed be mounted in such a way that the hole-trapping agent becomes supplied underneath the surface of the solution where the silver halide is precipitated. To express it in another way: the third inlet should be positioned closer to the silver salt inlet than to the halide inlet. The injection of the hole-trapping agent as close as possible to the silver salt inlet is preferred while the combined and simultaneous addition of the hole-trapping agent and the silver salt solutions through one inlet is one of the ultimate and most preferred configurations in order to reach the objects of the present invention. This can be extrapolated to all the precipitation systems wherein solutions of organic hole-trapping agent and silver salt are mixed together before the formation of the silver halide emulsion crystal, doped with an organic hole trapping agent. When very low concentrations of the said organic hole trapping agents already lead to the desired sensitometric effects, it is even possible to prepare a solution by mixing an aqueous silver nitrate solution and a solution of an organic hole trapping agent. In that case the third inlet can thus be deleted as it is redundant.

The tabular silver halide emulsion grains or crystals as mentioned hereinbefore can be prepared in various ways by conventional methods. As already shortly summarized these methods always start with a nucleation phase in controlled conditions of pAg and pH followed by one or more grain growth steps, after one or more physical ripening steps. In the emulsion preparation reactants are added to the reaction vessel in form of solutions of silver salts and halide salts or in the form of preformed silver halide nuclei or fine grains which easily dissolve in the precipitation medium. The individual silver and halide salt solutions can be added through surface or subsurface delivery tubes by hydrostatic pressure or by an automatic delivery system for maintaining the control of pAg and/or pH in the reaction vessel and of the rate of the reactant solutions introduced in it. The adjustment of the pAg and pH value is very important in connection with the use of compounds which satisfy formula (I) for emulsions of the present invention while it determines the activity of these organic hole trapping dopants. The pH is therefore preferably situated between 1 and 10 but most preferably between 2 and 8. The pAg at the other side is preferably situated between 2 and 9 and most preferably between 3 and 8.

As taught for the compounds used for incorporation in the tabular silver halide emulsions according to the present invention the reactant solutions or dispersions for the preparation of the silver halide itself can be added at a constant rate or at a constantly increasing, decreasing or fluctuating rate, if desired in combination with stepwise delivery procedures.

The tabular silver halide photographic emulsions of the present invention prepared in this way contain silver halide crystals comprising chloride, bromide or iodide alone or in combinations and have a {111} or a {100} crystal habit, depending on the precipitation conditions. Other silver salts which principally can be incorporated in a limited amount in the silver halide lattice are silver phosphate, silver thiocyanate, silver citrate and some other silver salts. Chloride and bromide salts can be combined in all ratios to form a silver chlorobromide salt. Iodide salts however can be precipitated together with chloride and/or bromide salts in forming a iodohalide with an iodide amount which depends on the saturation limit of iodide in the lattice with the given halide composition; this means up to a maximum amount of about 40 mole percent in silver iodobromide and up to at most 13 mole procent in silver iodochloride both based on silver. Preferred silver halide emulsions are silver bromoiodide with not more than 20 mol % of iodide, silver chloroiodide with not more than 8 mol % of iodide and silver chlorobromiodide with a maximum of 40 mol % of bromide and not more than 4 mol % of iodide. The composition of the halide can change in the crystal in a continous or in a discontinous way. Emulsions containing crystals composed of various sections with different halide compositions are used for several photographic applications. Such a structure with a difference in halide composition between the center and the rest of the crystal, called a 'core-shell'-emulsion, or with more than two crystal parts differing in halide composition (called a 'band'-emulsion) may occur. Changes in halide composition can be realized by direct precipitation of the corresponding halide salt solutions when mixing with an aqueous silver nitrate solution, or, in an indirect way, by making use therefore of fine silver halide grains having a well-defined silver halide composition which are dissolved in the presence of the so-called host grains thereby forming a 'shell' or 'band' on the given 'basic' or 'core' grain. This mechanism proceeds as a consequence of Ostwald ripening, being a physical ripening mechanism driven by differences in grain size and solubility thereof. Addition of iodide, normally performed by addition of an inorganic iodide salt or, if slower liberation of iodide in the reaction is desired, by addition of organic iodide releasing agents, leads to an increased iodide content by conversion, wherein iodide ions are replacing halides of more soluble silver halide salts as bromide or chloride. Addition of iodide is however also possible by adding fine preformed grains of silver iodide, whether or not including bromide and/or chloride in minor amounts, said grains having a grain diameter of not more than 100 nm, and, more preferably, not more than 50 nm. Such fine grains are so-called "Lippmann" emulsions.

Addition of iodide by organic agents releasing iodide ions, which is an embodiment which can advantageously be applied within the context of the preparation of emulsions according to the present invention, is in favour of the realization of homogeneous distribution of iodide into the crystal volume of {111} tabular grains or crystals containing silver iodide as has been demonstrated e.g. in EP-A's 0 561 415, 0 563 701, 0 563 708 and 0 651 284 and in U.S. Pat. Nos. 5,482,826 and 5,736,312. In this context {111} tabular grains rich in silver chloride can be prepared as has been described in EP-A 0 678 772, wherein an emulsion has been claimed comprising silver chlorobromoiodide or silver chloroiodide tabular grains having {111} crystal faces, having at least 75 mole % of chloride and from 0.1 up to less than 1 mole % of iodide, based on silver, having an average aspect ratio of at least 8:1, an average grain thickness of from 0.08 $\mu$m to less than 0.2 $\mu$m, wherein at least 50% of the total projected area is provided by said tabular grains, wherein said grains have a variable iodide profile, built-up by introduction of an organic compound releasing iodide ions. In an alternative method iodide ions can be released from iodate as has been described in U.S. Pat. No. 5,736,312. In the preparation of {100} tabular grain emulsions containing huge amounts of chloride, iodide may preferably be introduced in form of an iodide releasing substance before 3% of the silver salt has been precipitated as has been demonstrated in Research Disclosure 394010, published Feb. 1, 1997.

Addition of iodide as fine silver iodide grains, which is an embodiment which may advantageously be applied within the context of the present invention, can be performed as has been described for the preparation of {111} tabular grains in JP-A's 04251241 and 08029904 and in EP-A's 0 662 632 and 0 658 805, wherein an outermost phase rich in silver iodide has been added to {111} tabular grains rich in silver bromide. More particularly ultrafine AgI-grains can be introduced as seed emulsions as has been described in EP-A 0 621 505 or can be used in order to prepare core-shell emulsions as described in EP-A 0 517 434, wherein two phases in the crystal differing in composition have thus been built up. {111} tabular silver bromoiodide or bromochloroiodide emulsions having low amounts (0.005 up to less than 0.3 mole %) of silver iodide can thus advantageously be prepared as has been described in EP-A 0 475 191, in favour of rapid processing applicability. {100} tabular emulsion grains rich in silver chloride, wherein AgI has been introduced internally into the grain volume can be prepared as has been described in JP-A's 08095182 and 08292511. Release of iodide in the presence of a compound adjusting the rate of iodide release can be applied as described in U.S. Pat. No. 5,807,663 in order to get a multilayered structure in the silver halide tabular emulsion grains.

More in general according to the present invention emulsions having {111} tabular crystals rich in silver bromide may be prepared, as described in the patent literature, apart from addition of organic hole trapping agents according to the formula (I). So as has been described in EP-A 0 731 378 regions of different iodide concentration can be present in the crystal volume; and as further described in EP-A 0 699 948, wherein silver halide is deposited epitaxially onto the tabular grains, or as in EP-A 0 701 164, where an iodide rich zone is present at the border of the crystal and wherein epitaxial deposits have further been located at the surface site or in U.S. Pat. No. 5,698,387 wherein more sophisticated epitaxial deposits have been described for composite tabular grain emulsions. Alternatively {111} tabular crystals having a lower surface iodide concentration at their corners if compared with their edges can be prepared as in EP-A 0 736 199. Tabular grains substantially free from silver iodide in favour of speed, contrast and speed-granularity relationship can be prepared as in U.S. Pat. No. 5,614,359. Even ultrathin grains having a thickness of 0.07 $\mu$m or even less can be prepared as has been described in EP-A 0 699 948 and U.S. Pat. No. 5,641,618.

Further according to the present invention emulsions having {111} tabular crystals rich in silver chloride may be prepared, as described in the patent literature, apart from addition of organic hole trapping agents according to the formula (I). So apart from emulsions as described in EP-A 0 678 772, already mentioned above, emulsions disclosed in Research Disclosure 388046, published Aug. 1, 1996, can be used. In that Research Disclosure {111} tabular grain emulsions treated with iodide for enhanced morphological stability and enhanced photographic performance have been described. Moreover {111} tabular silver chloro(bromo) iodide emulsions may be prepared as has been described in EP-A 0 866 362, wherein an improved homogeneity has been obtained. It is well-known that in order to prepare {111} tabu-lar silver halide crystals rich in silver chloride habit modifying agents are required in order to stabilize the said habit. Preferred crystal habit modifiers therefore are azine or xanthinoid compounds as disclosed in EP-A 0 577 173, amino azine compounds as in EP-A 0 584 811, iodo-substituted 8-hydroxyquinoline as in EP-A 0 694 810, iodo substituted phenols as in EP-A 0 694 809, pyridinium salts as in U.S. Pat. No. 5,691,128, etc., without however being limited thereto. Adenine is one of the most preferred as described in EP-A 0 481 133.

As crystal habit modifying agents are adsorbed onto the {111} crystal surface, competition between the said agents and spectral sensitizers and/or stabilizers may cause problems with respect to sensitometry (decreased speed, gradation, etc.) and/or reproducibility. Therefore according to the present invention emulsions having {100} tabular crystals rich in silver chloride may be prepared, as described in the patent literature, apart from addition of organic hole trapping agents according to the formula (I). The {100} crystals are prepared without the need for a crystal habit modifying or stabilizing agent as has been described in EP-A's 0 534 395, 0 569 971, 0 584 644, 0 584 815, 0 617 317, 0 617 320, 0 617 321, 0 618 482, 0 620 479, 0 645 022, 0 645 670, 0 653 669, 0 670 514, 0 670 515, 0 672 940, 0 762 192, 0 767 400, 0 768 567, 0 800 108, 0 803 139, 0 843 207, 0 911 688, 0 932 077 and 0 949 536 and in U.S. Pat. Nos. 5,292,632; 5,320,938; 5,356,764; 5,395,746; 5,558, 982; 5,641,620; 5,654,133; 5,565,315; 5,607,828; 5,663, 041; 5,665,530; 5,695,922 and 5,707,793.

More details about ways of making a silver halide emulsion according to the present invention, apart from addition of organic hole trapping agents according to the formula(e) (I), can be found in the review published September 1996 in Research Disclosure 38957, and more particularly in section I-C. An emulsion of the present invention can thus be described in an almost identical way which is very particular for these emulsions wherein the grains have an outermost shell which is only distinguished from the core portion by the presence of the organic hole trapping dopant according to formula (I). In a preferred embodiment there is no difference in the halide composition between the core and the shell (occluding the organic hole trapping agent(s)) as is normally the case in the emulsions used in the art. Important with respect to the present invention is the amount of silver present in the outermost shell containing organic hole trapping dopant(s) satisfying formula (I) which should be less than 95% of the total amount of silver of the whole grain but preferably less than 65% and most preferably less than 45%.

It is clear that in favour of reproducibility of the grain distribution and in favour of the ability to calculate amounts of all kinds of compounds to be added to the emulsion, like spectral sensitizers, stabilizers, etc, the silver halide tabular crystals should have a "monodisperse" distribution.

It is further clear that also a monodisperse crystal habit is preferred: for {111} tabular crystals this is expressed as an amount by number of hexagonal grains of at least 90%, and still more preferably at least 95%. The photosensitive silver halide emulsion according to the present invention should therefore contain tabular silver halide grains present in a numerical amount of at least 50%, more preferably at least 70% and still more preferably at least 90%, said tabular grains having an average aspect ratio of at least 1.2, more preferably at least 5, still more preferably at least 8 and even up to 20, an average equivalent circular grain diameter of at least 0.1 $\mu$m, more preferably at least 0.3 $\mu$m and still more preferably at least 0.5 $\mu$m up to 50 $\mu$m and an average grain thickness of less than 0.3 $\mu$m, more preferably less than 0.25 $\mu$m and still more preferably from 0.07 up to 0.20 $\mu$m, with variations on average equivalent circular grain diameter and/or variations on average grain thickness of all tabular grains of less than 0.30, and more preferably from 0.10 up to 0.20. Monodispersity with respect to crystal diameter and/or thickness is thus highly preferred. This monodispersity is expressed as variation on the average crystal diameter and/or variation on average grain thickness of said individually measured tabular crystals from the whole tabular grain population, which should be less than 0.30 and more preferably even less than 0.20, e.g. about 0.15 being most preferred.

{111} tabular grains therefore should have predominantly hexagonal or predominantly triangular grains and mixtures thereof should be avoided as much as possible. In the context of the present invention preferable methods which can be used for preparing such emulsions having monodispersed hexagonal tabular grains have been described in EP-A 0 515 106 and U.S. Pat. Nos. 4,797,354 and 4,996,137. When triangular grains (rich in silver bromide) are preferred preparation methods therefore as described in EP-A 0 754 964 and the corresponding U.S. Pat. No. 5,733,715 are recommended. When more specifically monodispersity on thickness of the grains is preferred, it is recommended to make use of preparation methods as described in U.S. Pat. Nos. 5,370,985 and 5,587,280 and in EP-A's 0 843 208 and 0 859 273. More specifically with respect to monodisperse core-shell emulsions preparation methods as described in EP-A's 0 228 914, 0 264 954, 0 273 411, 0 296 606, 0 312 959, 0 326 852, 0 359 506, 0 391 560, 0 408 752, 0 410 410, 0 416 881, 0 421 740, 0 443 453, 0 443 475, 0 492 519, 0 503 700, 0 517 434, 0 543 319, 0 547 912, 0 554 735, 0 557 695 and 0 660 175 and in U.S. Pat. Nos. 4,439,520; 4,668,614; 4,689,292; 4,797,354; 4,806,461; 4,835,095; 4,883,748; 4,977,074; 5,032,494; 5,156,944; 5,244,781; 5,306,611; 5,312,727; 5,368,999; 5,424,181; 5,478,714; 5,587,280 and 5,792,601 can advantageously be used.

Specific measures in order to provide monodispersity of tabular grains in the preparation method thereof and which can also be advantageously be used in the context of the present invention have been described in U.S. Pat. No. 5,248,587 wherein a low temperature growth process has been described, in U.S. Pat. No. 5,484,697 wherein use of an external static nucleator or recipient with a very low agitation speed has been described,in U.S. Pat. No. 5,215,879, wherein use of water soluble polymers has been suggested in nucleation and Ostwald ripening step of the emulsion preparation, in U.S. Pat. No. 5,693,459, wherein polyalkylene oxide block copolymer surfactants have been used (besides cationic starch used as a peptizer), in U.S. Pat. Nos. 5,439,787; 5,712,083 and 5,773,207, wherein specific polymers having polyalkylene oxide units are used and in EP-A 0 735 412, wherein polyoxyalkylene siloxane has been added in the preparation step and in EP-A 0 932 077, wherein specifically in the Preparation of {100} tabular emulsion crystals rich in silver chloride polyoxyalkylene block-copolymers have been used.

In a particular embodiment the tabular silver halide emulsions of the current invention have, besides having incorporated organic hole trapping dopants according to the formula (I) also incorporated electron trapping compounds which can be introduced during precipitation. Said electron trapping compounds are well-known for people skilled in the art and are normally simultaneously incorporated in the silver halide grains with the same or a different concentration profile as the dopants according to formula (I). These electron trapping compounds which are regularly occluded in a silver halide crystal lattice are preferably metal coordination complexes which are replacing an appropriate amount of silver and halide ions in the silver halide crystal lattice. These electron trapping dopants which are occluded in the lattice can be distinguished from the metal-complex introduced in the emulsion as an additive by EPR- or ENDOR-techniques. The EPR-technique and sample preparation has been described in U.S. Pat. No. 5,457,021 by Olm et al. and by H. Vercammen, T. Ceulemans, D. Schoenmakers, P. Moens and D. Vandenbroucke in Proc. ICS&T of 49th Ann.Conf., p.54 (Minneanapolis, May 14–24, 1996). The description of the ENDOR-technique is given in the same Proc.Ann.Conf., p.56 by P. Moens, H. Vercammen, D. Vandenbroucke, F. Callens and D. Schoenmakers. Those metal complexes mentioned just hereinbefore are modifying the crystal structure and are further influencing the properties of the crystal. A lot of parameters like sensitivity, gradation, pressure sensitivity, high or low intensity reciprocity failure, stability, dye desensitization, and several other sensitometric aspects of a photosensitive silver halide emulsion can also be modified by a selective choice of the dopant but in a way strongly differing from the way in which organic hole trapping dopants incorporated in tabular silver halide emulsions of the present invention are acting. The activity of the electron trapping dopants is influenced by the type of dopant, its concentration, its valency and location in the crystal in case of incorporation of the said dopant in form of a single metal ion. When coordination complexes or even oligomeric coordination complexes are used the different ligands bound at the central metal ion can be occluded in the crystal lattice too and will in this way influence the photographic properties of the silver halide material as well (see Research Disclosure, 38957 (1996), p. 591, section I-D).

In a further embodiment emulsions of the present invention have an electron-trapping agent which is occluded in the silver halide grains. From the different electron-trapping agents which can be distinguished, only the non-permanent traps are of interest for the present invention. These traps have a partial positive charge and are able to capture photo-electrons for a very short time after their generation. They are also able to prevent, for a short time, a photoelectron to recombine with a photo-hole and to increase the change that the electron will be used for the formation of a latent image. Therefore the silver halide grains have to be doped with a shallow electron trapping agent so that more photo-electrons can be used for the latent-image formation process. When the photoelectrons are generated by the absorption of light, they are attracted by the net positive charge at the dopant site and temporarily held with a binding energy that is equal to the local decrease in the conduction band energy. The dopant that causes the localized bending of the conduction band to a lower energy is referred to as a shallow electron trap because the binding energy holding the photoelectron at the dopant site is insufficient to keep it permanently on that place. For a dopant to be useful in forming a shallow electron-trap it must satisfy criteria beyond simply providing a net valence more positive than the net valence of the ion or the ions it displaces in the crystal lattice. For a dopant to be useful as a shallow electron-trap it must satisfy following additional criteria:

(1) its highest energy occupied molecular orbital (HOMO) must be filled and (2) its lowest energy unoccupied molecular orbital (LUMO) must be at a higher energy level than the lowest energy level of the conduction band.

If conditions (1) and/or (2) are not satisfied, there will be a local, dopant-derived orbital in the crystal lattice at a lower energy than the local dopant-induced conduction band minimum energy, and photo-electrons will preferentially be held at this lower energy site and thus impede the efficient migration of photoelectrons to latent-image forming sites.

The activity of these dopants as shallow electron-trapping agent can be evaluated by EPR spectroscopy and by photoconductivity techniques. The electron paramagnetic resonance (EPR) technique is in fact the only technique—apart from derived techniques, such as electron nuclear double resonance (ENDOR)—which enables an unambiguous detection of the functionality of these shallow electron traps, as quoted also in Olm et al in U.S. Pat. No. 5,503,970. Checking of SET-activity of a dopant by EPR should be carried out in silver halide crystals which do not contain the organic hole-trapping dopant, characteristic for of the present invention. The shallowly trapped photo-electrons give rise to an EPR signal, which is composed of a single line with a g-value that is characteristic for the local halide composition in the silver halide lattice. So it has e.g. been shown by R. S. Eachus, M. T. Olm, R. Janes and M. C. R. Symons, *Phys. Stat. Sol.* 152, 583 (1989), that the g-value of the shallowly trapped electron in AgCl is 1.880±0.001 and for AgBr is 1.49±0.02. The g-value in EPR is characteristic for each species under study, and can be calculated and measured as described in e.g. Electron Paramagnetic Resonance: Techniques and Applications, written by Raymond S. Alger, (1968) published by Interscience publishers, New York. The width of the line, as a function of temperature and concentration of the added dopant complex, has been described by H. Vercammen, D. Schoemaker, D. Vandenbroucke, Proceedings of the 1997 *International Symposium on Silver Halide Imaging*, Victoria—BC, Canada, 1997, p. 125. In that reference the line width of the EPR signal of shallowly trapped electrons at 20 K is quoted to be 1.0±0.1 mT for a dopant concentration of 1 ppm. This parameter (line width) can be used as a thorough check of the concentration of the dopant which is effectively built in. Furthermore only the simulation of the line shape as described in the latter reference can yield useful information about the intensity of the EPR line which can give indications about the presence of a SET. The procedure followed for the identification of the dopants in the present invention is nearly identical to the one proposed by M. Olm et al. (U.S. Pat. No. 5,503,970). Powders of the emulsions were prepared in the following way: the gelatine was enzymatically removed and the emulsion crystals were sedimented; the solution was decanted and the precipitates were washed; the powder was dried before EPR characterization. These powders were sealed in a quartz tube and mounted in a cryostat in the EPR cavity. In this way the emulsion powders could be routinely measured at 2K. This low temperature is chosen to elimate other electronic or ionic events. The powders were then exposed using a 200 W XeHg lamp with a color filter (SCHOTT UV-DAD 8-1, $\lambda_{max}$=365.9 nm, max transmittance of 44.9% and HW=8.7 nm). After 1 min exposure at 2K, during which the quartz tube is rotated to ensure complete illumination, the EPR spectrum is measured.

To the recorded spectra of the test and reference emulsions a gaussian line shape was fitted by a computer program in order to determine the intensity and line width of the signal around g=1.88 (see description in the latter reference mentioned hereinbefore). If the intensity of the line, measured in 'arbitrary units' (=a.u.) is increased by at least 20% relative to the line measured in the reference emulsion powder, then the dopant complex is a shallow electron trap.

The second method which can be used in order to detect the presence of shallow electron-traps in silver halide crystals, preferably if no organic hole-trapping agent is present, is photoconductivity measurement at room temperature or low temperature. If shallow electron-traps are present in the crystal the lifetime of the photo-electrons will increase. Increased photo-electron lifetimes of a doped emulsion compared with the undoped reference is therefor an important indication that the dopant is working as a SET-agent. A definition of electron-lifetime and a description of the method for photoconductivity measurement is given at the ICPS-98 conference (Antwerp, Sep. 7–11, 1998) by Hua et al (ICPS-98 Proceedings, vol 1, p.92–96) and A.Hirano (ICPS-98 Proceedings, vol 1, p.89–92).

A lot of examples of other dopants which satisfy the aforementioned criteria and which can be used in the context of the present invention are summarized and described in Research Disclosure, 36736, November 1994, p. 657–660.

Special attention should be drawn to the use of shallow electron-trapping agents as described in the EP-A 0 945 and which is represented therein by the general formula $[ML_{6-n}F_n]^{m-}$, wherein:

M represents a metal selected from the group consisting of the metals belonging both to Group 7, 8, 9 and 10 and to the Periods 4, 5 and 6 of the Periodic System of Elements, L represents one halogen atom or a mixture of at least two different halogen atoms selected from the group consisting of Cl, Br and I, n equals a value satisfying following equation: $1 \leqq n \leqq 6$, m equals a value of 1, 2, 3 or 4.

A lot of parameters like sensitivity, gradation, pressure sensitivity, high or low intensity reciprocity failure, stability, dye desensitization, and several other sensitometric aspects of a photosensitive silver halide emulsion can also be modified by selection of the dopant as known in the art but in the present invention the shallow electron trap (SET) especially influences the sensitivity. The type of dopant, its concentration and location in the crystal are all very important for the activity of the dopant. Said dopant is also suitable for use, in favour of sensitivity. When incorporated in non-tabular silver halide crystals it may be divided homogeneously over the whole grain volume, but in favour of sensitivity it is more particularly preferred when incorporated in the shell of a cubic core-shell emulsion crystal. In the class of non-tabular grains there are a lot of possibilities, wherein a dopant may be incorporated into the grains including an organic hole trapping dopant as is characteristic for the tabular grains of the present invention: more regularly shaped crystals (cubic, octahedral) are well-known besides crystals with a mixed crystal habit (e.g. cubes with rounded edges). Application to cubic grains of rongalites has been described e.g. in EP-A 0 922 994.

With respect to the preparation of relatively monodisperse tabular grain emulsions having a core-shell structure methods for incorporating SETs as described in EP-A's 0 322 861 and 0 552 650, in the EP-A 0 945 755 mentioned above and in U.S. Pat. Nos. 4,439,520; 4,806,462; 5 5,348,850 and 5,374,513 can be applied in order to reach the objects of the present invention.

According to the present invention a photosensitive element has also been provided, said element comprising a support and on at least one side thereof a silver halide emulsion layer, comprising silver halide grains prepared in the presence of an oxidizing agent and an organic hole trapping dopant, said element comprising moreover silver halide tabular grains composed of at least one halide selected from the group consisting of chloride, bromide and iodide. It should be recommended that for certain applications it is important to apply a well-defined amount of iodide on the crystal surface under controlled conditions in order to get reproducible sensitometric results after image-wise exposure and subsequent processing. In that case it is preferably performed by making use of an iodide releasing agent or by making use of fine silver iodide emulsions grains (see references given hereinbefore).

A hydrophilic colloid is used as a binder or a protective colloid for the emulsion or any other layer of the photographic material of the invention. Gelatin is an advantageously used hydrophilic colloid. The preparation of conventional lime-treated or acid-treated gelatin has been descibed in e.g. "The Science and Technology of Gelatin", edited by A. G. Ward and A. Courts, Academic Press 1977, page 295 and further. The gelatin can also be enzyme-treated as described in Bull.Soc.Sci.Phot.Japan, Nr 16, page 30 (1966).

Special kinds of pretreated gelatin may be used as e.g. gelatin having a lower calcium content or even free from calcium ions, as disclosed in JP-A's 01073337, 06067329 and 07140576 and in EP-A's 0 809 135 and 0 843 207. Other pretreated gelatins may be used such as oxidized gelatins having a low methionine content or gelatins rich in methionine content, whether or not in combination with modification of the calcium content as has been disclosed in EP-A's 0 227 444, 0 228 256, 0 423 840, 0 697 618, 0 843 207, 0 843 208, and in U.S. Pat. Nos. 4,942,120; 5,252,452 and 5,587,281.

Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof.

Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerisable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch or modified (oxidized) starch as disclosed in EP-A's 0 756 199, 0 756 198, 0 758 758, 0 758 759, 0 758 760 and in U.S. Pat. Nos. 5,607,828; 5,667,955; 5,693,459; 5,726,008 and 5,733,718. Further synthetic high molecular compounds described in JP-B-52–16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used.

Part of gelatin may further be replaced with a synthetic or natural high-molecular material. Specific synthetic polymers or copolymers, whether or not in combination with gelatin and/or other hydrophilic colloids, and having an effect on monodispersity of the grain distribution may advantageously be used, such as those described in EP-A's 0 633 494 and 0 784 229 and in U.S. Pat. Nos. 5,215,879; 5,595,863; 5,712,083 and 5,693,459.

An interesting substitute for gelatin may be silica as has been described in the published EP-A's 0 392 092, 0 517 961, 0 528 476, 0 649 051 and 0 704 749 and more particularly in order to prepare silver halide tabular grains in EP-A's 0 677 773 and 0 767 400.

The emulsions can be coagulated and washed after precipitation in order to remove the excess soluble salts. These procedures are together with different alternative methods like dia- or ultrafiltration and ion-exchange described in Research Disclosure N°. 38957, published September 1996, section III.

Additional gelatin or another hydrophilic colloid, suitable as a binder material can be added at a later stage of the emulsion preparation e.g. after washing, to establish optimal coating conditions and/or to establish the required thickness of the coated emulsion layer. Preferably a gelatin to silver halide ratio, silver halide being expressed as the equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure N° 38957 (1996), Chapter II.

The emulsions can be surface-sensitive emulsions which form latent images primarily on the surface of the silver halide grains or they can be emulsions forming their latent-image primarily in the interior of the silver halide grain. The emulsions can further be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

Sensitization can be carried out in many different ways. There can be a chemical sensitization with a middle chalcogenic compound (as sulfur, selenium and tellurium), gold, a metal of the platinum group of the Periodic System of Elements (like platinum, palladium, rhodium, ruthenium, iridium and osmium) or combinations of these sensitizers which reaction on its turn can be influenced by the pAg, the pH and temperature of the medium where the chemical sensitization takes place. The chemical sensitization can also be optionally conducted in the presence of for instance thioether compounds, thiocyanate derivatives, stabilizers, spectral sensitizers, etc. The emulsion can also be sensitized by what is called reduction sensitization. If desired this can be combined with the aforementioned chemical sensitization methods. A complete description of all the possibilities of sensitization which can be used in the present invention can be found in Research Disclosure N° 38957, published September 1996, section IV.

The tabular silver halide emulsions of the present invention may be spectrally sensitized after precipitation, before, during or after chemical sensitization with dyes from different classes which include polymethine dyes comprising cyanines, merocyanines, tri-, tetra- and polynuclear cyanines and merocyanines, oxanols, hemioxanols, styryls, merostyryls and so on. In the present invention special attention has to be given to the use of J-aggregating dyes (see 'The Theory of the Photographic Process', T. H. James ed., 4th ed.(1977) p.218–222, and T. Tani in 'Photographic Sensitivity. Theory and Mechanisms', Oxford Univ.Press, New York-Oxford, 1995). These J-aggregating dyes are preferably used in combination with J-aggregating 'tuning'-compounds or -products or -agents. These special 'tuning'-compounds are able to modify the J-aggregate to a certain desired size. This so-called 'J-aggregate-tuning'-compounds are well-known and can be for instance a dye (as described by A. A. Muenter, et al, J.Phys.Chem., 96(1992)2783) or other compounds like alcohols, surfactants, ketones, photographic stabilizers and various other products (see for instance A. H. Herz, Phot.Sci.Eng.,18(1974)323). J-aggregate-tuning compounds which are important and preferably used in the context of the present invention are the photographic stabilizers.

In some circumstances one or more spectral sensitizers may be used if a larger part of the spectrum has to be covered. Combinations of several spectral sensitizers are sometimes used to get supersensitization, which means that in a certain region of the spectrum the sensitization is greater than that from any concentration of one of the dyes alone or that which would result from the additive effect of the dyes. Generally supersensitization can be attained by using elected combinations of spectral sensitizing dyes and other addenda such as stabilizers, development accelerators or inhibitors, brighteners, coating aids, and so on. In special applications as described in EP-A's 0 786 690, 0 786 691, 0 786 692, 0 809 139, and 0 862 088; in EP-A 0 890 873, 98201401 filed Apr. 29, 1998 and 98202081 filed June 22, 1998 and in U.S. Pat. Nos. 5,637,447; 5,641,618 and 5,691,127 emulsions prepared and spectrally sensitized as set forth therein can be used as silver halide emulsions of this inventions provided that the specific conditions with respect to the presence of an organic hole trapping agent according to the formula (I) are fullfilled. A good description of various other possibilities in spectral sensitization which can be important with respect to this invention is disclosed in Research Disclosure N° 38957, published September 1996, section V.

The photographic elements comprising the silver halide emulsions according to the present invention can include various compounds which should play a certain role in the material itself or afterwards in the processing, finishing or warehousing the photographic material. These products can be stabilizers and anti-foggants. Antifoggants prevent the occurance of fog while stabilizers have a function of stabilizing sensitometric properties. Antifoggants and stabilizers are used in the preparation, storage or processing stage of the photographic material. Frequently used antifogging agents and stabilizers are e.g. azoles, mercaptopyrimidines, mercaptotriazines, azaindenes, etc. Further suitable examples are e.g. those described in Research Disclosure N° 38957, published September 1996, section VII.

The hydrophilic colloidal layers (silver halide emulsion layer, backing layer, antihalation layer, etc.) of the photographic material wherein emulsions according to the present invention are used may contain an inorganic or an organic hardening agent (see Research Disclosure N° 38957, published September 1996, section IIB). More particularly with respect to tabular silver halide crystals hardening may be performed to such an extent that the hydrophilic layers of the material wherein one or more light-sensitive emulsion layers are present have a swelling degree of less than 300%, more preferably less to 200% and still more preferably less than 150%, without having a negative influence on covering power as can be expected following U.S. Pat. No. 4,414,304. Said swelling degree is determined after measuring the total layer thickness after swelling "$t_s$" of the material after having dipped it during 3 minutes into demineralized water at 20° C. and making the difference with the dry layer thickness "$t_d$". In order to reach such a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Further suitable possibilities for hardening can be found in Research Disclosure N° 38957, published September 1996, section IIB.

Further compounds may be added to materials having light-sensitive emulsion layers having tabular silver halide emulsions according to the present invention as brighteners (see Research Disclosure N° 38957, published September 1996, section VI), light absorbers and scattering materials (see Research Disclosure N° 38957, published September 1996, section VIII), coating aids (see Research Disclosure N° 38957, published September 1996, section IXA), antistatic agents (see Research Disclosure N° 38957, published September 1996, section IXC), matting agents (see Research Disclosure 38957, published September 1996, section IXD) and development modifiers (see Research Disclosure N° 38957, published September 1996, section XVIII).

The said photographic element comprising tabular silver halide emulsions according to the present invention may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer as e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α,β-unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 56–2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Research Disclosure N° 38957, published September 1996, Section VI, wherein also suitable optical brighteners are mentioned.

Spacing agents may further be present in materials comprising tabular silver halide emulsions according to the present invention, the average particle size of which is comprised between 0.2 and 10 μm. Those spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophtha-late. Other suitable spacing agents have been described in U.S. Pat. No. 4,614,708.

Prior to coating any thickening agent may be used in order to regulate the viscosity of the coating solution, provided that they do not particularly affect the photographic characteristics of the silver chloroiodide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica as has e.g. been described in EP-A 0 831 362. Alternatives in order to regulate viscosity, more particularly when no or only minor amounts of gelatin are present have been described in EP-A 0 813 105, wherein synthetic clay is used in combination with lower amounts of anionic macromolecular polyelectrolytes.

The photographic elements can be coated on a variety of supports which can be flexible or rigid. The flexible materials include plastic films (as e.g. polyesters like polyethylene terephthalate, polyethylene naphthalate, etc., polyethers, polycarbonates, polyvinylchloride and the like and papers, while the rigid materials include glass, metals, etc. The surface of the support is generally subjected to undercoating treatment (like corona discharge, irradiation with ultraviolet rays, etc) to enhance the adhesion of the silver halide emulsion layer (see Research Disclosure 38957, published September 1996, section XV, and the references cited therein).

The photographic elements comprising light-sensitive layers having tabular grain emulsions according to the present invention can be exposed to actinic radiation, specially in the visible, near-ultraviolet and near-infrared region of the spectrum, to form a latent image (see Research Disclosure N° 38957, published September 1996, section XVI). Various exposure means can be employed for exposure of the photographic material of the invention. As the light source, any optional light source releasing a radiation corresponding to the wavelength region wherefore the photographic material has been made sensitive can be employed. Examples of the light sources generally used include natural light, incandescent lamp, halogen lamp, mercury lamp, fluorescent lamp and all types of flash light sources. Light sources that emit light in the ultraviolet to infrared region can also be used as recording light sources. Photographic materials can for example also be exposed to gas lasers, semiconductor lasers, light emitting diodes or plasma light sources. In the same way the material can be exposed to a LCD-'light source' or to a fluorescent surface given by a phosphor stimulated with X-rays or electron rays. In that case single side coated silver halide photographic materials are exposed after contact has been made with a so-called intensifying screen having luminescent phosphors as is done in mammographic diagnostics, described e.g. in EP-A's 0 610 609, 0 712 036 and 0 874 275. In medical X-ray applications, as for chest imaging and the like, use is made from double-side coated film materials wherein the screens are positioned at both sides of the said materials as has e.g. been described in EP-A's 0 592 724 and 0 661 592. Such film materials may be built up symmetrically or asymmetrically, as well as the screen-pairs in contact therewith. Even when radiographic materials have been built up symmetrically, it may be possible to coat more than one emulsion layer on each side thereof, wherein said layers are sensitive to differing wavelength ranges and wherein exposure of the said layers is performed by luminescence after exposure with X-rays of a mixture of phosphors providing luminescent light of both differing wavelength ranges as has e.g. been described in U.S. Pat. No. 5,380,636. Asymmetrical screen/film assemblies which may be used have been extensively demonstrated in EP-A's 0 350 883, 0 407 890, 0 412 730 and 576 910. Differences in speed (sensitivity) and/or gradation of both layers at one or both sides of the support are normally optimized in order to get an enhanced image quality (especially sharpness), a decreased cross-over (in favour of image definition), and/or an enhanced exposure latitude and improved curve form.

Direct X-rays, β- or γ-rays are further included as possible light sources as is e.g. applied in non-destructive testing applications as has been described e.g. in EP-A 0 757 286 and in EP-A 0 890 873.

The latent-image formed in the silver halide crystals after exposure can be processed in order to form a visible image. Therefore various methods are known and many developing, fixing and stabilizing agents are described for the formation of photographic silver image. Know-how for processing photographic silver halide materials which can principally be used in relation with the present invention has been described in Research Disclosure N° 176043, published December 1978, sections XIX to XXIV and in Research Disclosure 38957, published September 1996, section XIX.

In the conventional way of processing most of the materials are developed by means of a liquid containing hydroquinone as main developing agent usually in combination with a so-called auxiliary developer. In a alternative way of processing hydroquinone is incorporated in the photographic material itself while the processing liquid is a mere alkaline solution. However it is important to realize that hydroquinone is suspect in various ways specially in an ecological and medical point of view. The present invention is also related with a more ecological way of processing where hydroquinone is at least partly replaced by ascorbic acid as developing agent. Ascorbic acid should be interpreted in a broad sense and includes ascorbic acid isomers, derivatives, salts and analogous compounds (including some reductones and reductic acid derivatives). The most preferred compounds are ascorbic acid, iso-ascorbic acid and their salts and reductic acid. Useful combinations of developers containing an ascorbic acid developing agent which should be preferably used in the scope of the present invention is described for many applications (in graphics, radiography, etc) in Research Disclosure N° 37152, published March 1995, p.185–224 and in EP-A's 0 731 381, 0 731 382 and 0 732 619.

The photographic emulsions according to the present invention can also be used in multi-layered multicolor materials. These materials comprise a support and two or more silver halide emulsion layers that have different spectral sensitivities. The multi-layered color photographic material generally comprises at least one red-sensitive emulsion layer, at least one green-sensitive emulsion layer and at least one blue-sensitive emulsion layer on a support. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer in order to enhance the sensitivity. More information useful in making use of emulsions according to the present invention in color materials can be found in Research Disclosure, item No. 37038, published Feb. 1, 1995; item No. 39423 and 39433, both published Feb. 1, 1997 and item No. 40145, published Sep. 1, 1997 as well as in EP-A 0 582 000 and in U.S. Pat. No. 5,569,576. The silver halide material may also contain different types of couplers which are incorporated in color photographic materials in order to provide color images after coupling with oxidized developer molecules. The red-sensitive emulsion layer generally contains a cyan coupler, the green-sensitive layer generally contains a magenta coupler and the blue-sensitive emulsion layer generally contains a yellow coupler. A specific layer built-up for color negative materials has e.g. been described in EP-A's 0 582 000 and 0 738 918. All information important for the application of emulsions of the present invention in these type of materials has been extensively described in Research Disclosure N° 38957, published September 1996, section X. More information with respect to the various color applications which belong also to the scope of the present invention, can be found in DE-Applications Nos. 19846750, filed Oct. 10, 1998; 19845642, filed Oct. 5, 1998; 19843082, filed Sep. 19, 1998; 19831281, filed Jul. 13, 1998; 19751447, filed Nov. 20, 1997; in 19747624, filed Oct. 29, 1997 in EP-A's 0 070 182, 0 070 183, 0 083 377, 0 265 590, 0 271 066, 0 273 411, 0 369 486, 0 421 426, 0 426 194, 0 435 295, 0 437 859, 0 447 534, 0 459 349, 0 495 364, 0 517 214, 0 551 130, 0 554 735, 0 557 695, 0 559 311, 0 560 036, 0 603 654, 0 628 856, 0 677 782, 0 684 511, 0 697 626, 0 703 493, 0 708 932, 0 709 731, 0 721 147, 0 726 493, 0 816 911, 0 845 703, 0 859 273 and in U.S. Pat. Nos. 5,455,146; 5,567,571; 5,593,820; 5,672,467; 5,691,130; 5,698,379; 5,702,878; 5,744,290 and 5,795,706.

Processing in order to form a visible dye image for colour materials means contacting the element with a colour developing agent in order to reduce developable silver halide and to oxidize the colour developing agent which in turn normally reacts with a coupler to form a dye as extensively described in Research Disclosure N° 38957, published September 1996, section XX. More specific information is found in EP-A's 0 295 716, 0 318 992, 0 326 030, 0 589 323, 0 591 883, 0 617 322, 0 617 324, 0 617 325, 0 724 190, 0 838 721, and in U.S. Pat. Nos. 4,695,529; 4,966,835; 5,455,146; 5,478,704; 5,667,949; 5, 698,379; 5,750,325.

According to a further preferred embodiment of the present invention a photothermographic recording material has been provided, wherein said material comprises a support bearing a photo-adressable thermosensitive element further comprising a substantially light-insensitive organic silver salt, an organic reducing agent therefor in thermal working relationship therewith, a binder and an emulsion according to the present invention as set out hereinbefore. Use of tabular silver halide emulsion grains in photothermographic elements in general and layer build-up of such photothermographic elements has e.g. been set forth in EP-A 0 844 514 wherein a detailed description has been given about a photothermographic dry silver recording material.

The invention is described hereinafter by way of the following examples, without however being limitative thereto and hereinafter will clearly illustrate the advantages which can be realized with the emulsions described in the present invention and the materials coated with light-sensitive layers containing said emulsions.

EXAMPLES

Example

Tabular Silver Bromide Emulsion

For the preparation of this emulsion the following solutions were prepared:

| | |
|---|---|
| Solution (1.1): | 1500 ml of an aqueous solution of $AgNO_3$ (1.96 M) |
| Solution (1.2): | 1500 ml of an aqueous solution of KBr (1.96 M) |
| Solution (1.3): | |
| gelatin | 50 g |
| demineralized water | 500 ml |
| Solution (1.4): | |
| KBr | 1.47 g |
| Oxidized gelatin | 7.5 g |
| $H_2SO_4$ (6 N) | 14.2 |
| demineralized water | 2856 ml |
| Solution (1.5): | |
| Polystyrene sulphonic acid (20 wt %) | 40 ml |
| Solution R1: | 0.09 grams of Na-rongalite/l |
| Solution R2: | 0.18 grams of Na-rongalite/l |
| Solution R3: | 0.36 grams of Na-rongalite/l |

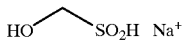

sodium salt of rongalite (called Na-rongalite hereinbefore)

The Precipitation Step

Comparative Emulsion (1)

The pH of the solution (1.4) was adjusted at a value of 1.8 with a sulphuric acid solution and pBr adjusted at 2.39 with KBr. The solutions (1.1) and (1.2) were kept at room temperature while solutions (1.3) and (1.4) were heated to 60° C. 7.35 ml of solution (1.1) and 7.35 ml of solution (1.2) were added to solution (1.4) in 9 seconds. After 2 minutes the temperature was increased to 70° C. in 25 minutes followed by the addition of solution (1.3) and adjusting the pH at 6 with NaOH. 6 minutes later the following steps are subsequently carried out:

- a first neutralization step with addition at a rate of 7.5 ml/min. of solution (1.2) during 330 seconds.
- a second neutralization step with 7.5 ml of solution (1.1) added during 1 minute, while solution (1.2) was added at such a rate that the pAg was controlled at a constant value of 8.85,
- a first growth step adding solution (1.1) during 33 minutes and 22 seconds at a constant increasing rate (end rate of 23.1 ml/min is almost 3 times higher than the starting rate of 7.5 ml/min). Solution (1.2) was added in order to keep the pAg at 8.86,
- a third neutralization step with the addition of 56.25 ml of solution (1.1) during 7.5 minutes,
- a fourth neutralization step with the addition of solution (1.1) for 1 minute at a fixed rate of 7.5 ml/min and of solution (1.2) in such a way that the pAg was brought to 7.38,
- a second growth step wherein 911 ml of solution (1.1) was added at a constant growing rate during 41 minutes and 2 seconds starting at 7.5 ml/min and ending at 36.9 ml/min. Solution (1.2) was added in order to keep the pAg at 7.38.
- the addition of solution (1.5) after bringing the pH at 3.5, in order to flocculate the emulsion followed by 3 washing cycles for desalting the emulsion.

After the washing procedure gelatin and water were added to the precipitate in order to get an emulsion having 200 grams of $AgNO_3$ per kg with a gelatin/silver nitrate ratio of 0.34.

The pH- and pAg-values measured after peptization were respectively 5.1 and 7.85. The thus prepared silver bromide emulsion had hexagonal {111} tabular crystals in a numerical amount of at least 95% with a thickness of 0.21 $\mu$m and an average diameter d, equivalent with a sphere having the same average volume as the reduced crystals of 0.7 $\mu$m. A variation coefficient on thickness of the grains of 0.15 has been calculated.

Inventive Emulsion (2)

Emulsion (2) was prepared in the same way, except for addition during the second growth step of a sodium salt solution of rongalite (solution R1) which was added during 377 seconds with a flow rate of 10 ml/min. The addition was started 1579 seconds after the start of Solution (1.1).

Inventive Emulsions (3) and (4)

Emulsions (3) and (4) were prepared in the same way as inventive emulsion (2), except that rongalite solutions (R2) and (R3) were used for the respective emulsions.

Coating Procedure

The emulsions were coated at 40° C. after adding the appropiate wetting and hardening agents on a subbed PET base support. The amount of coated gelatin was 2.0 g/m2 and the gelatin/$AgNO_3$ ratio 1.27. The pH and the pAg of the coating solution was respectively kept at 6.1 and at 8.66.

Exposure and Processing

The emulsions were image-wise exposed through a step-wedge original (constant=0.15) and a color filter V405 using a $10^{-2}$ sec Xenon flash. The exposed photographic materials were developed in a G138®-developer at a temperature of 33° C. for 28 seconds, fixed for 22 seconds (also at 33° C.) in a commercial fixer G334® (1 part was diluted with 4 parts of demineralized water) and washed during 19 seconds at ca 27° C. G138 and G334 are trademarketed products (Agfa-Gevaert N. V., Mortsel, Belgium).

Evaluation of the Results

The results listed in Table 4 describe following parameters:

- $D_{min}$ is the fog level (expressed with an accuracy of 0,01);
- $D_{max}$ is the maximum density (expressed with an accuracy of 0,01),
- 'Sens(0.2>fog)' means the sensitivity in log(It)-units which is realized at a density of 0.2 above fog level,
- 'Sens(80%Dmax)' means the sensitivity in log(It)-units which is realized at 80% of $D_{max}$,
- 'Sens(0.1>fog)' means the sensitivity in log(It)-units which is realized at a density of 0.1 above fog level, 'G' means gradation (contrast) calculated between 25% and 75% of the whole density range above fog;

the rongalite sodium salt-concentration, called [HO—$CH_2$—$SO_2$—Na] is expressed in mole/mole $AgNO_3$, From the results in Table 4 hereinafter it is clear that the occlusion of Na-rongalite in a tabular silver halide crystal increases the sensitivity of the chemically unsensitized emulsions which are irradiated or exposed by light that is absorbed by the silver halide itself (Experiments Nos. 1–4).

TABLE 4

Tabular AgBr-emulsion doped with Na-rongalite.

| No | [HO—$CH_2$—$SO_2$—Na] | $D_{min}$ | $D_{max}$ | S 0.2 > fog | S 80% Dmax | S 0.1 > fog | G | |
|---|---|---|---|---|---|---|---|---|
| 1 | 0 | 0.027 | 0.77 | 1.76 | 2.25 | 1.58 | 0.79 | comp. |
| 2 | $1.25 \times 10^{-5}$ | 0.027 | 0.84 | 1.71 | 2.32 | 1.50 | 0.78 | inv. |
| 3 | $2.50 \times 10^{-5}$ | 0.030 | 0.30 | 1.39 | 1.97 | 1.20 | 0.86 | inv. |
| 4 | $5.00 \times 10^{-5}$ | 0.032 | 0.32 | 1.30 | 1.89 | 1.14 | 1.19 | inv. |

Having described in detail preferred embodiments of the current invention, it will now be apparent to those skilled in the art that numerous modifications can be made therein without departing from the scope of the invention as defined in the following claims.

What is claimed is:

1. Photosensitive silver halide emulsion containing tabular silver halide grains present in a numerical amount of at least 50%, said tabular grains having an average aspect ratio of at least 1.2, an average equivalent circular grain diameter of at least 0.1 um and an average grain thickness of less than 0.3 $\mu$m characterized in that said grains further include an organic hole trapping dopant, and the organic hole trapping dopant has a formula (I) as follows:

formula I

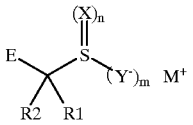

wherein

X and Y each independently represents O, S or Se;

$R^1$ and $R^2$ each independently represents hydrogen, an alkyl, an aryl, an aralkyl, a heteroaryl;

wherein $R^1$ and $R^2$ can be the same or different and may form a ring;

E represents a group linked to the carbon atom by a heteroatom, having at least one free electron pair;

$M^+$ is a proton or a counterion; and wherein m equals 1 and n equals 1 or 2.

2. Emulsion according to claim 1, wherein said grains have a core and an outermost shell, wherein said organic hole trapping dopant is present in the outermost shell of the said grain.

3. Emulsion according to claim 2, wherein said outermost shell represents a procentual amount of silver versus the total amount present of less than 95%.

4. Emulsion according to claim 1, wherein variations on average equivalent circular grain diameter and/or variations on average grain thickness of all tabular grains are from 0.10 up to 0.20.

5. Emulsion according to claim 1, wherein said halide is selected from the group consisting of chloride, bromide and iodide and mixtures thereof.

6. Emulsion according to claim 1 wherein the organic hole-trapping dopant according to the formula (I) is a rongalite, present as a sulfinic acid or an inorganic or organic salt thereof.

7. Emulsion according to claim 1 wherein $M^+$ in formula (I) representing the hole trapping dopant is an alkaline or alkaline earth metal ion or an organic group which can be an ammonium-cation in form of $^+NR^3R^4R^5R^6$, wherein the groups $R^3$ to $R^6$ may be the same or different and wherein each of $R^3$ to $R^6$ independently represents hydrogen, alkyl, aryl, or a phosphonium, selenonium, iodonium, telluronium or sulphonium ion.

8. Emulsion according to claim 1, wherein the organic hole trapping dopant is added in an amount of $10^{-2}$ up to $10^{-8}$ mole per mole of silver halide.

9. Emulsion according to claim 1, wherein said tabular silver halide emulsion grains further contain an electron-trapping agent.

10. Emulsion according to claim 9, wherein the electron-trapping agent is a shallow electron trap forming dopant.

11. Emulsion according to claim 10, wherein the shallow electron trap forming dopant induces an increase in line intensity of an EPR-signal of at least 20% at a g-value characteristic for a given halide composition of said emulsion.

12. Emulsion according to claim 1, further comprising at least one J-aggregating dye as spectral sensitizer.

13. Emulsion according to claim 12, further comprising a J-aggregate tuning product.

14. Emulsion according to claim 13, wherein said J-aggregate tuning product is a stabilizer.

15. Emulsion according to claim 1, wherein said emulsion has a pH-value in the range from 1 up to 10, and a pAg-value in the range from 2 up to 9.

16. Silver halide photographic material comprising a photosensitive emulsion according to claim 1.

17. Photothermographic recording material comprising a support bearing a photo-adressable thermosensitive element further comprising a substantially light-insensitive organic silver salt, an organic reducing agent therefor in thermal working relationship therewith, a binder and an emulsion according to claim 1.

* * * * *

UNITED STATES PATENT AND TRADEMARK OFFICE

CERTIFICATE OF CORRECTION

PATENT NO. : 6,277,550 B1
DATED : August 21, 2001
INVENTOR(S) : Kathy Elst et al.

It is certified that error appears in the above-identified patent and that said Letters Patent is hereby corrected as shown below:

Title page,
Item [73], Assignee, Agfa-Gevaert, Mortsel (DE) " should read -- (73) Assignee, Agfa-Gevaert, Mortsel (BE) --

Under "Related U.S. Application Data
[60] Provisional application No. 60/119,064, filed on February 5, 1999." should read
-- Related U.S. Application Data
[60] Provisional application No. 60/119,064, filed on February 8, 1999. --

Column 1,
Lines 5-6, "This appln claims benefit of provisional appln 60/119,064 Feb. 5, 1999." should read:
-- This application claims benefit of U.S. provisional application No. 60/119,064, filing date February 8, 1999. --

Column 13,
Line 26, "14-24, 1996)" should read -- 19-24, 1996) --.

Signed and Sealed this

Ninth Day of April, 2002

*Attest:*

*Attesting Officer*

JAMES E. ROGAN
*Director of the United States Patent and Trademark Office*